United States Patent [19]

Bunger

[11] Patent Number: 5,069,143

[45] Date of Patent: Dec. 3, 1991

[54] DUAL PURPOSE PLATFORM FOR MOBILE STORAGE BUILDINGS

[76] Inventor: Richard E. Bunger, 1834 W. 3rd St., Tempe, Ariz. 85281

[21] Appl. No.: 707,159

[22] Filed: May 28, 1991

[51] Int. Cl.[5] ..... B65D 19/00

[52] U.S. Cl. ..... 108/51.1; 52/143; 52/79.1

[58] Field of Search ..... 108/51.1; 52/79.1, 79.6, 52/143, 656

[56] References Cited

U.S. PATENT DOCUMENTS

| | | | |
|---|---|---|---|
| 2,828.931 | 4/1958 | Harvey | 52/143 X |
| 3,023,463 | 3/1962 | Bigelow, Jr. | 52/143 X |
| 3,726,424 | 4/1973 | Du Puis et al. | 108/51.1 X |
| 3,751,870 | 8/1973 | Vesei | 52/143 X |
| 3,992,848 | 11/1976 | Stucy | 52/79.1 X |
| 4,112,854 | 9/1978 | Pitchford | 108/51.1 X |
| 4,597,339 | 7/1986 | McCaffrey et al. | 108/51.1 |

*Primary Examiner*—Peter A. Aschenbrenner
*Attorney, Agent, or Firm*—Warren F. B. Lindsley

[57] ABSTRACT

A platform for supporting a movable storage building employing a pair of parallely and spacedly positioned rails between which are supported a plurality of laterally extending floor joists. The rails each provide a U-shaped channel for receiving the ends of the floor joists and a pair of spacedly positioned openings which expose channels juxtapositioned to and parallel with the floor joists for receiving the prongs of a forklift mechanism.

6 Claims, 2 Drawing Sheets

DUAL PURPOSE PLATFORM FOR MOBILE STORAGE BUILDINGS

BACKGROUND OF THE INVENTION

This invention relates to a platform for supporting a movable storage building and more particularly to a novel panel for not only supporting the floor of a building but also forming pockets or channels therein for receiving the prongs of a forklift mechanism for building moving purposes.

DESCRIPTION OF THE PRIOR ART

Although platforms designed for movement by a forklift mechanism are well known in the art, none are known which serve the dual function of supporting a building as well as defining channels for receiving the prongs of a forklift truck.

SUMMARY OF THE INVENTION

It is, therefore, one object of this invention to provide a new and improved floor panel or platform for a mobile mini storage building which platform defines pockets or channels for receiving the prongs of a forklift mechanism for building moving purposes.

Another object of this invention is to provide a dual purpose floor panel or platform for a mobile building that provides suitable openings for the prongs of a forklift mechanism for lifting purposes while additionally reinforcing the strength of this load bearing member.

A still further object of this invention is to provide a novel platform for a mobile storage building which cooperates with the siding of the building to direct rain water away from the base of the building.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figures 1, 2, 3, 6:
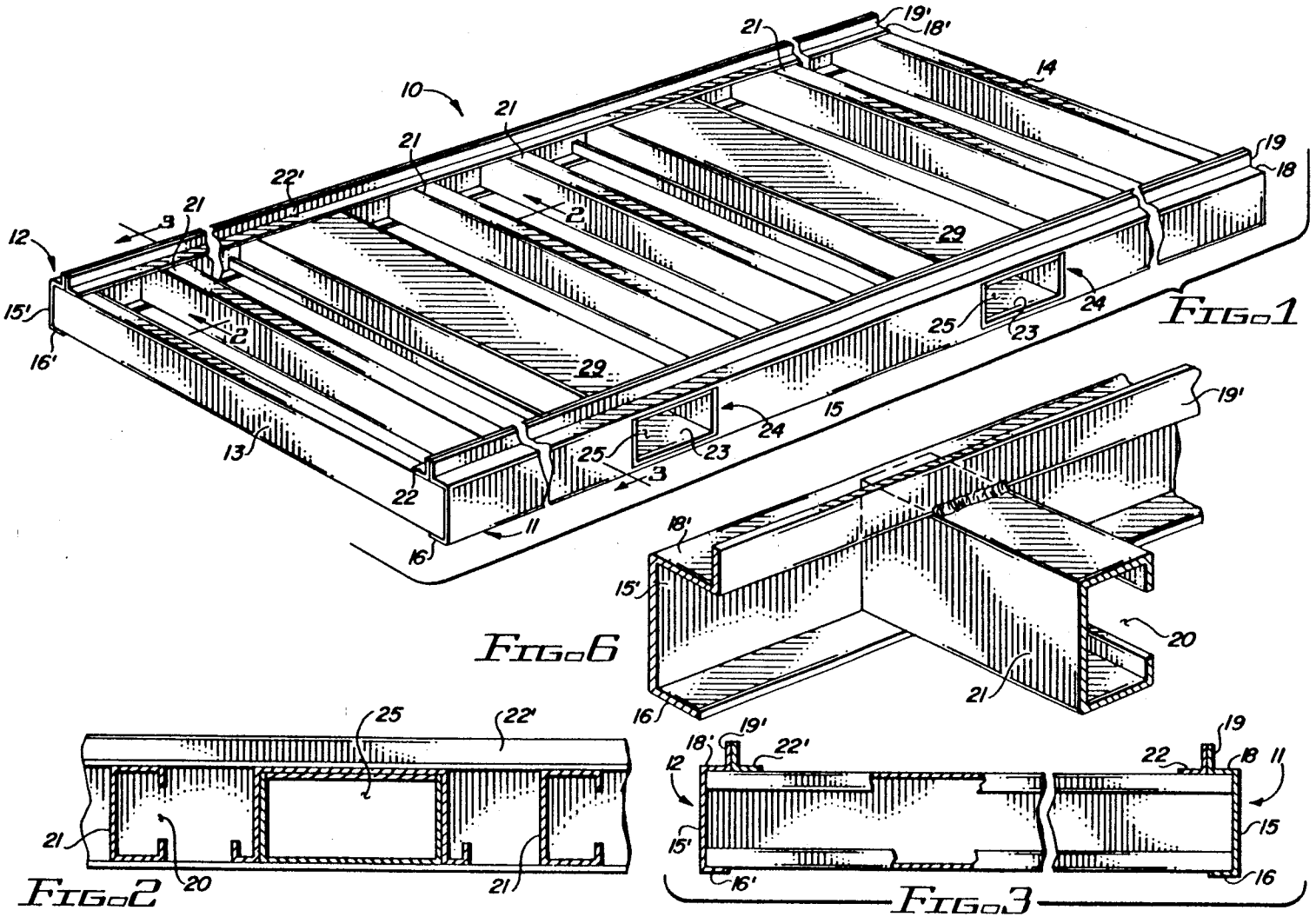
FIG. 1 is a perspective view of a platform for supporting the floor of a movable building and embodying the invention.
FIG. 2 is a cross sectional view of FIG. 1 taken along the line 2—2.
FIG. 3 is cross sectional view of FIG. 1 taken along the line 3—3.
FIG. 6 is a partial view of the interconnection of one of the channels forming an opening for a prong of a forklift mechanism with a longitudinal rail of the panel.
Figures 4, 5:
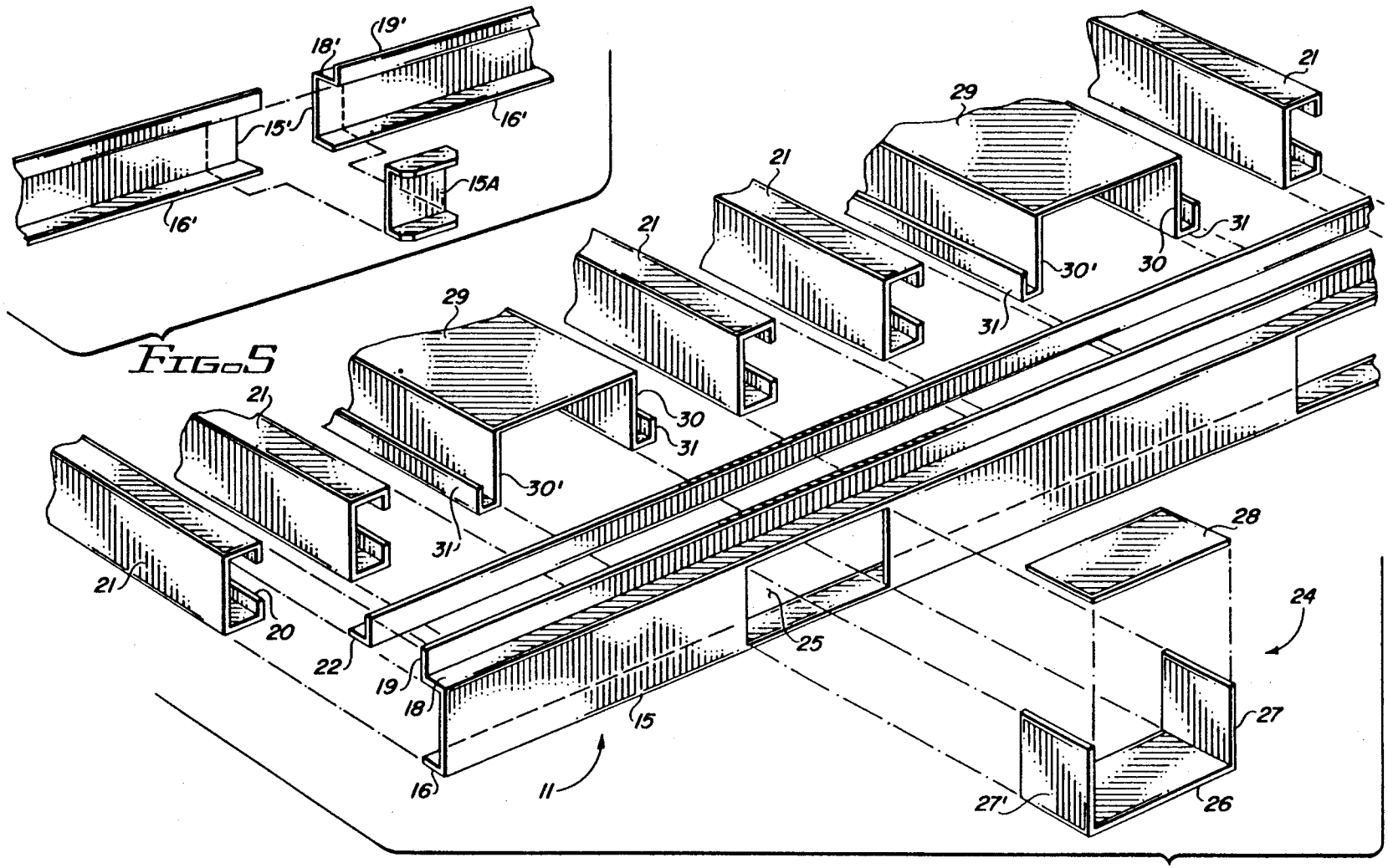
FIG. 4 is a partial exploded view of FIG. 1.
FIG. 5 is a partial view of a means for interconnecting a pair of sections which form one of the longitudinal rails of the platform shown in FIG. 1.

Referring more particuarly to the drawings by characters of reference, FIGS. 1–6 disclose a platform 10 for supporting a mobile building thereon. This platform comprises a pair of spacedly positioned parallely arranged rails 11 and 12 which are held together in a rectangular configuration by a pair of end members 13 and 14.

Rails 11 and 12 comprise elongated panels 15, 15' the base edges of which are bent over at ninety degree angles to provide flanges 16, 16' and panels 18, 18' at the top thereof which are bent over in the same direction as flanges 16, 16' which are bent again to form further flanges 19, 19'. Flanges 19, 19' extend at ninety degree angles from panels 18, 18', respectively, in the manner shown. As noted from FIG. 5 each rail may comprise one or more sections held together by a clip 15A that overlaps the juxtapositioned edges of the rails and is secured thereto.

End members 13 and 14 comprise hollow rectangular channels, which may have a C-shaped cross sectional configuration the ends of which are arranged to fit within the U-shaped indentations in rails 11 and 12 formed by flanges 16, 16' and panels 18, 18', as shown in FIG. 1, with the opening 20 facing inwardly of the platform. Similar hollow channel members or floor joists 21, which may have a C-shaped cross sectional configuration, are spacedly arranged in a parallel configuration between rails 11 and 12 along the length of the platform.

It should be noted that elongated right angle channels 22, 22' are secured, as by spot welding, to the back surface of flanges 19, 19' of panels 15, 15' and floor joists 21 to form a unitary structure.

To aid in lifting and moving the platform and any building mounted on this platform by a forklift mechanism, a pair of pockets 23 are built into the platform.

These pockets each comprise a collar or frame 24 extending into and around an opening 25 in rails 11 and 12 which frame comprises a bottom U-shaped member 26 the legs 27, 27' of which are spanned by a top plate 28. This frame extends inwardly of the associated rail a distance equal to the length of flanges 16, 16' and panels 18, 18'.

It should be noted that rail 12 is provided with the same types of openings with frames therearound as shown in FIG. 2, which openings and frames are axially arranged with the openings and frame formed in rail 11.

Pockets 23 each further comprise an elongated U-shapd channel member 29 the legs 30, 30' of which are bent over at their edges to provide a smaller U-shaped channel 31 along its longitudinal edges opening in a direction one hundred and eighty degrees out of phase with the opening of channel member 29. As shown, channel member 29 extends across the width of platform 10 and is anchored at each end around frame 24 in the associated rail. The top surfaces of channel members 29 and floor joists 21 lie in a common plane.

It should be noted that channels 29 form an integral part of the weight supporting platform. The rails 11 and 12 by means of its offset panels 18, 18' and vertical flanges 19, 19' provide a support for the sidewalls of a building mounted on the platform thereby preventing rain from leaking into the building at its base.

Although but one embodiment has been illustrated and described, it will be apparent to those skilled in the art that various changes and modifications may be made therein without departing from the spirit of the invention or from the scope of the appended claims.

What is claimed is:

1. A platform for a movable building comprising:

a frame, said frame comprising a pair of parallely arranged spacedly positioned rails and a plurality of parallely arranged spacedly positioned floor joists extending laterally of and between said rails, said rails each defining a U-shaped opening for receiving therein a different end of each of said floor joists and a flange extending laterally and upwardly of each of said rails for providing an outwardly positioned supporting surface for a side of a building, a pair of spacedly positioned channels parallely arranged with said floor joists between said rails, and a pair of spacedly positioned openings arranged in each of said rails, said channels each being positioned to axially align with one of said openings in each of said rails, whereby when prongs of a forklift mechanism penetrate a pair of said openings in one of said rails and the associated channels the platform and any building mounted thereon may be moved by said forklift mechanism.

2. The platform set forth in claim 1 in further combination with:

a collar mounted around each of said openings and extending inwardly of said rail, and the ends of each of said channels surround one of said collars.

3. The platform set forth in claim 1 wherein:

each of said floor joists comprises a hollow configuration.

4. The platform set forth in claim 3 wherein:

the cross section of each of said floor joists comprises a C-shaped configuration.

5. The platform set forth in claim 1 wherein:

each of said channels comprises a hollow U-shaped configuration.

6. The platform set forth in claim 1 wherein:

the top surfaces of the floor joists and channels lie in a common plane.

* * * * *